US005339732A

United States Patent [19]

Peterlini et al.

[11] Patent Number: 5,339,732

[45] Date of Patent: Aug. 23, 1994

[54] MACHINE FOR SILK-SCREEN PRINTING DECORATION OF THE OUTER SIDES OF CONTAINERS IN GENERAL

[75] Inventors: Franco Peterlini; Tiziano Schenetti; Marco Minardi, all of Reggio Emilia, Italy

[73] Assignee: M.O.S.S.-S.r.l., Reggio Emilia, Italy

[21] Appl. No.: 115,808

[22] Filed: Sep. 3, 1993

Related U.S. Application Data

[63] Continuation of Ser. No. 876,264, Apr. 30, 1992, abandoned.

[30] Foreign Application Priority Data

May 3, 1991 [IT] Italy ..... 000062 A/91

[51] Int. Cl.[5] ..... B41F 17/08; B05C 17/04

[52] U.S. Cl. ..... 101/38.1; 101/123; 101/124

[58] Field of Search ..... 101/35, 38.1, 39, 40, 101/40.1, 114, 115, 123, 124, 129

[56] References Cited

U.S. PATENT DOCUMENTS

| | | | |
|---|---|---|---|
| 3,249,043 | 5/1966 | Karlyn et al. | 101/124 X |
| 3,249,044 | 5/1966 | Karlyn | 101/38.1 |
| 3,659,522 | 5/1972 | Dubuit | 101/35 |
| 3,659,523 | 5/1972 | Olsen | 101/38.1 |
| 3,810,422 | 5/1974 | Kammann | 101/40 |
| 3,842,733 | 10/1974 | Dubuit | 101/38.1 |
| 4,068,579 | 1/1978 | Poo et al. | 101/38.1 |
| 4,109,573 | 8/1978 | Strauch et al. | 101/38.1 |
| 4,111,118 | 9/1978 | Green et al. | 101/123 |
| 4,282,806 | 8/1981 | Lala | 101/38.1 |
| 4,428,283 | 1/1974 | Rudolph et al. | 101/35 |
| 4,750,419 | 6/1988 | Meredith | 101/40 |
| 4,782,750 | 11/1988 | Marette | 101/39 |
| 4,945,847 | 8/1990 | Audi et al. | 101/35 |

FOREIGN PATENT DOCUMENTS

| | | | |
|---|---|---|---|
| 0179744 | 8/1986 | Japan | 101/124 |

*Primary Examiner*—Edgar S. Burr
*Assistant Examiner*—Christopher A. Bennett
*Attorney, Agent, or Firm*—Lowe, Price, LeBlanc & Becker

[57] ABSTRACT

A machine screen-prints the surface of flat objects or objects with a convex, curvilinear transverse section, such as bottles or cans. It is formed to be adapted rapidly for the printing of containers with any radius of curvature, however small, without having to go through the laborious replacement of mechanical parts and without causing harmful mechanical vibrations, even during heavy duty use. The machine includes a printing station in which the container (2) oscillates around a longitudinal axis passing through the center of the mouth of the container, with the top surface of the container, tangent to a screen (3) which moves in a longitudinal direction. The upper surface of the screen is scraped by a squeegee fitted above it which presses the ink through the mesh of the screen and is synchronized to operate alternately with it (in opposite directions). The bottom edge of the squeegee follows an arcuate oscillating trajectory. The machine is suitable for use in factories where screen-printing techniques are used.

13 Claims, 9 Drawing Sheets

Figure 1:
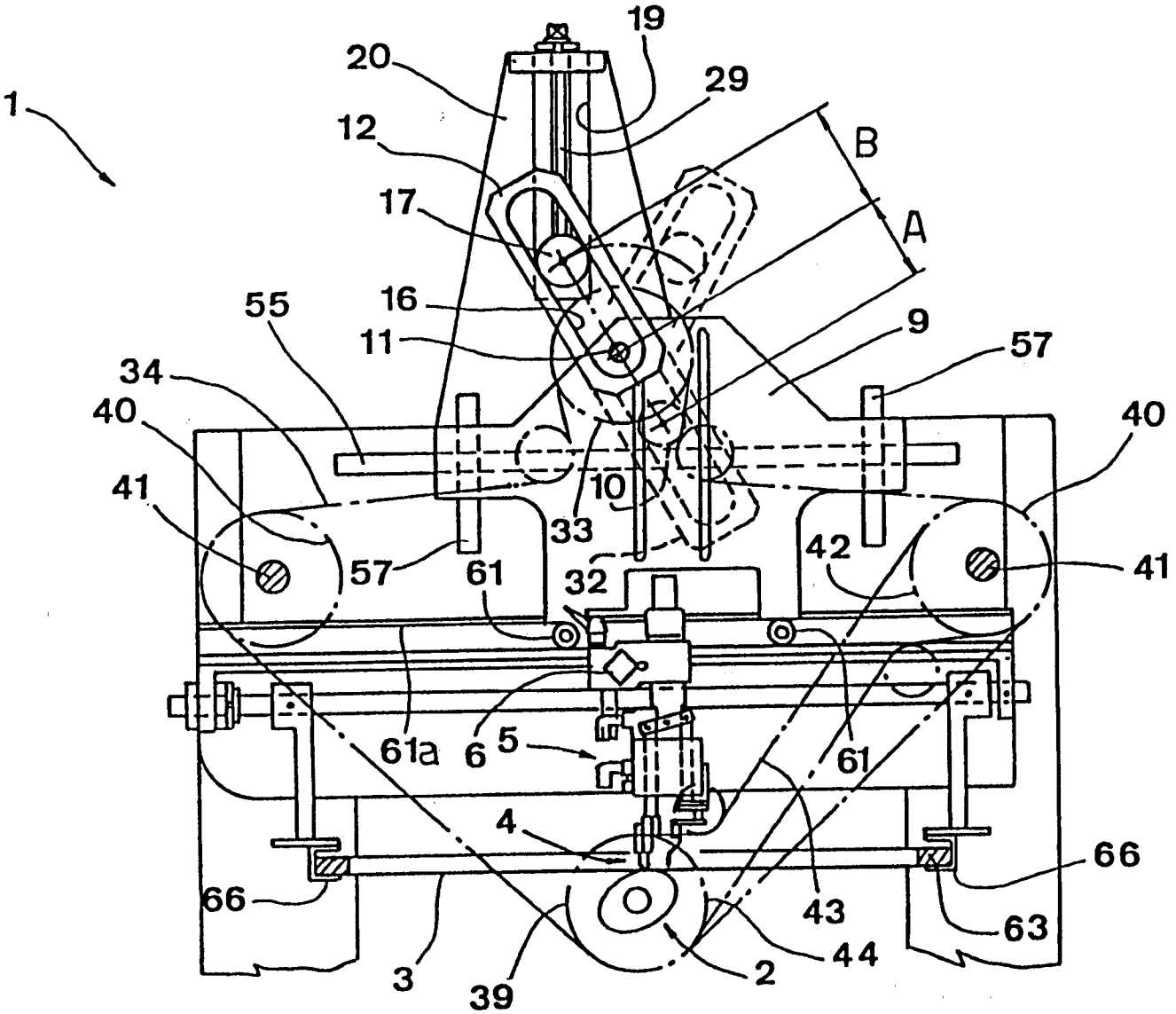

99
98
63
63
97
57
32
42
43
44
A1
10
9
61
94
91
96a
61
4
2
57
B1
92
5
3
55
61a
93
80
66
86
84
85
82
83

MACHINE FOR SILK-SCREEN PRINTING DECORATION OF THE OUTER SIDES OF CONTAINERS IN GENERAL

This application is a continuation of application Ser. No. 07,876,264 filed Apr. 30, 1992, now abandoned.

The invention concerns a machine used for silk-screen printing decoration of the outer sides of containers in general, in other words, a series of kinematic movements designed to apply, by means of a screen-printing process, a film of ink or glaze, which may or may not be coloured, onto the surface, convex at least in part, of containers for substances in liquid, granular or powder form, such as cans or bottles, made in the widest range of materials, including plastics in general.

The state of the art involves silk-screen printing machines for the decoration of hollow, elongated objects with a closed curvilinear, convex transverse section, at least in part, with either a circular or oval profile, or even elliptical; in said machines, these hollow objects, fixed to a conveyor chain, follow a flat trajectory and in the printing section, by operation of a cam deviating the trajectory of the chain, describe an arc with a radius of curvature corresponding to that of the profile of the transverse section of the container in the screen-printing zone; the serigraphic screen and the squeegee are kept in contact with the surface being printed and are driven in the direction of the printing: the difference in speed between the screen and the squeegee—the latter being slower than the former—allows the ink lying on the upper surface of the screen to be drawn through the mesh.

The state of the art also includes screen-printing machines in which the container, during the printing stroke, oscillates around a longitudinal axis, passing through the center of curvature of the surface being printed, by means of oscillating cranks engaging the edges of the container and having a length corresponding to that radius; a gear wheel is keyed to the pin of at least one of these crankshafts, meshing at the top with a horizontal rack used to move the screen; the squeegee, designed to scrape the upper surface of the screen and pressing the ink through it, is secured in place with its lower edge tangent to the surface being printed.

It also includes machines in which the container is supported at the ends by a pair of parallel oscillating levers, pivoted in a longitudinal axis, passing through the center of curvature of the surface being printed; a rotating pulley is fitted at the top of these levers, around which two lengths of belt are wound, on opposite parts of the pulley and up to about half its circumference, one end fixed to the edge of the pulley and the other to the screen-supporting frame, driving the frame through the printing stroke while the container oscillates; the squeegee is stationary and is supported to the upper surface of the screen, with its lower edge kept tangent to the container.

However, these machines, as far as the chain drive and deviating cam model and the model with a crank driving the screen by means of a cogged wheel and rack are concerned, involve the need to replace mechanical parts every time containers are printed with a different radius of curvature or when the same container is being printed but the surfaces to be decorated have a variable radius of curvature: such operations are time-consuming and require the intervention of skilled personnel, therefore resulting in increased costs; as regards the oscillating lever screen-printing machines, with screen driven by a pulley with belt lengths wound around it on opposite parts of the pulley, these do not produce an acceptable finish on containers whose printing surface has a small radius of curvature; this is due mainly to the large mass of the levers and the considerable vibrations caused by the machine, especially during heavy duty.

This state of the art is subject to considerable improvement, namely in solving the above-mentioned problems.

The above illustrates the need to resolve this technical problem, to find a screen-printing machine capable of printing flat or even convex surfaces, such as the outer sides of hollow, elongated objects, for example, containers for liquids, powders or other materials, whose transverse section has a closed curvilinear profile, characterized by arcs of circumference linked with each other; such a machine should be quickly and simply adaptable for the printing of surfaces with any radius of curvature, without the need to replace mechanical components and without causing harmful and troublesome vibrations whichever the working conditions may be; necessary adjustments to the machine in order for it to adapt to various different sizes of container, should be performed automatically, by a processor for example, which controls the activation of electromechanic actuators, such as step-by-step electric motors or other means; such a machine should be safe, reliable and economic.

The invention solves the technical problem referred to above by adopting a screen-printing machine where the body of the container oscillates around a longitudinal axis which passes through the center of the mouth of the container, its upper surface being tangent to a silk-printing screen which moves in a longitudinal direction and over which a squeegee, secured at right angles to the moving plane of the screen, moves in the opposite direction to that of the screen and is synchronized to operate alternately with it; the bottom of this squeegee oscillates along an arched trajectory, forming an arc of circumference whose radius is equal to the difference between the radius of curvature of the surface being printed and the minimum distance of this surface from the axis of rotation of the container; the maximum excursion followed by the trajectory of the squeegee at right angles with the surface of the screen is equal to the difference between the projection in that direction of the distance of the furthest external generatrix in the printing area from the axis of rotation of the container, and the minimum distance of that surface from the same axis.

The advantages offered by this invention are: the possibility of decorating containers without going through the laborious replacement of mechanical parts but by the simple, rapid and immediate adjustment of the screen stroke and the magnitude of the oscillating angles of the squeegee and the container; excellent printing quality for transverse sections of containers in the widest range of geometric shapes, and also for small curve radii, without causing harmful mechanical vibrations; automatic adjustment of oscillating amplitude and/or stroke of moving parts with the use of electromechanical actuators controlled by a processor or alternately, with the use of sensors; drastic reduction in costs, especially those incurred in connection with the storage of special spare parts used for different types of container, which with this invention are no longer required; guaranteed reliability and long working life.

Figure 2:
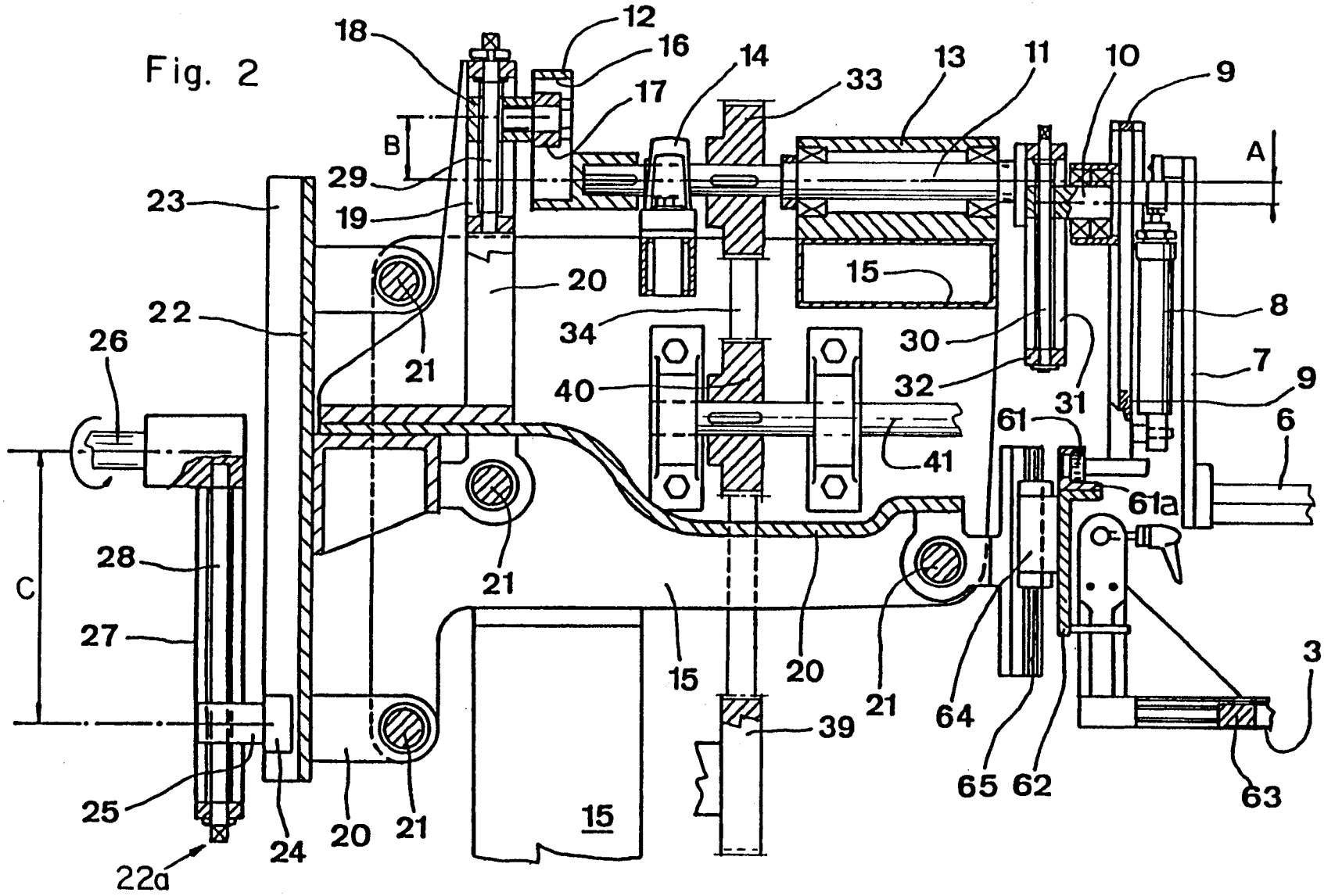
Figure 3:
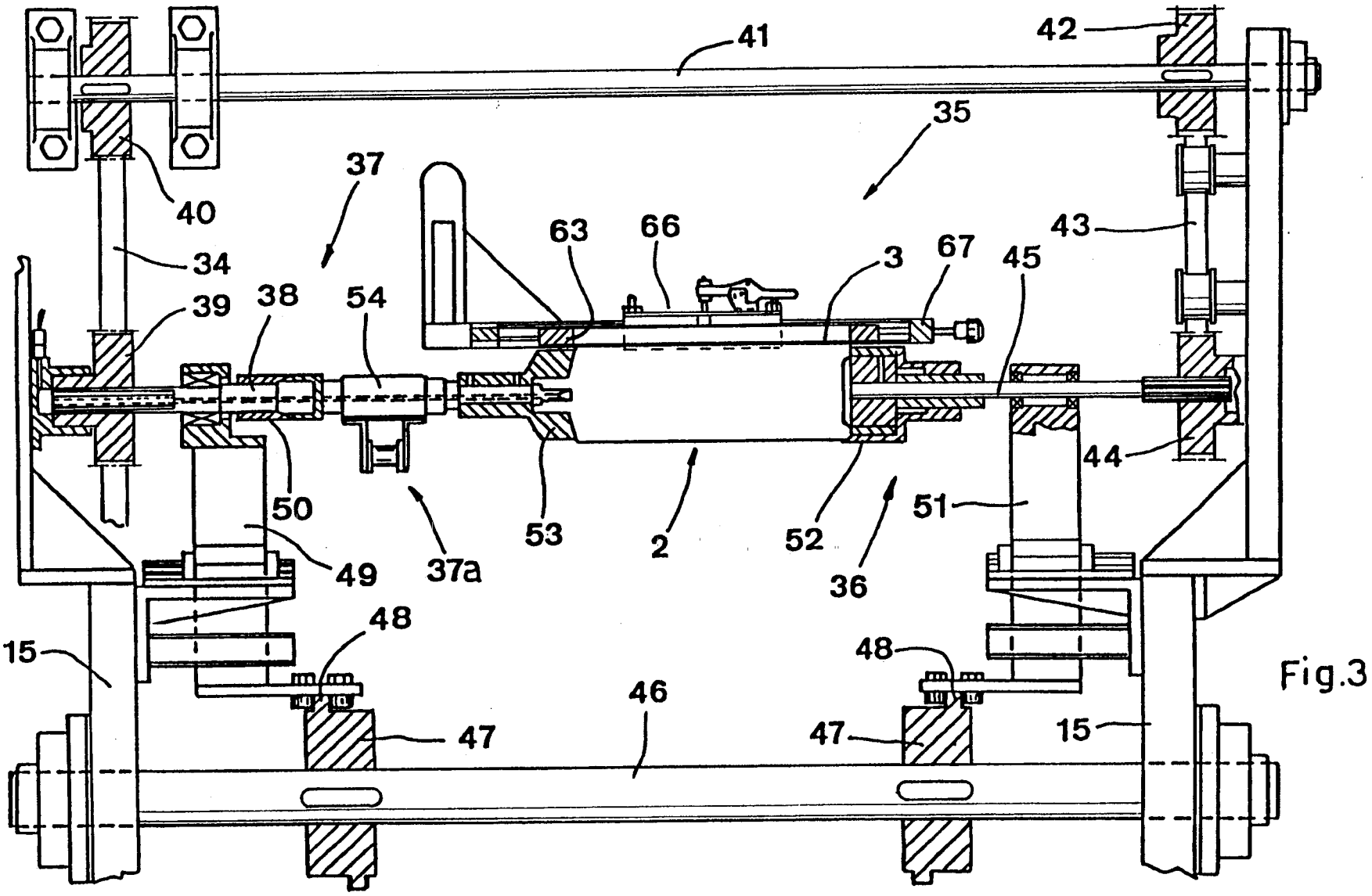
Figure 4:
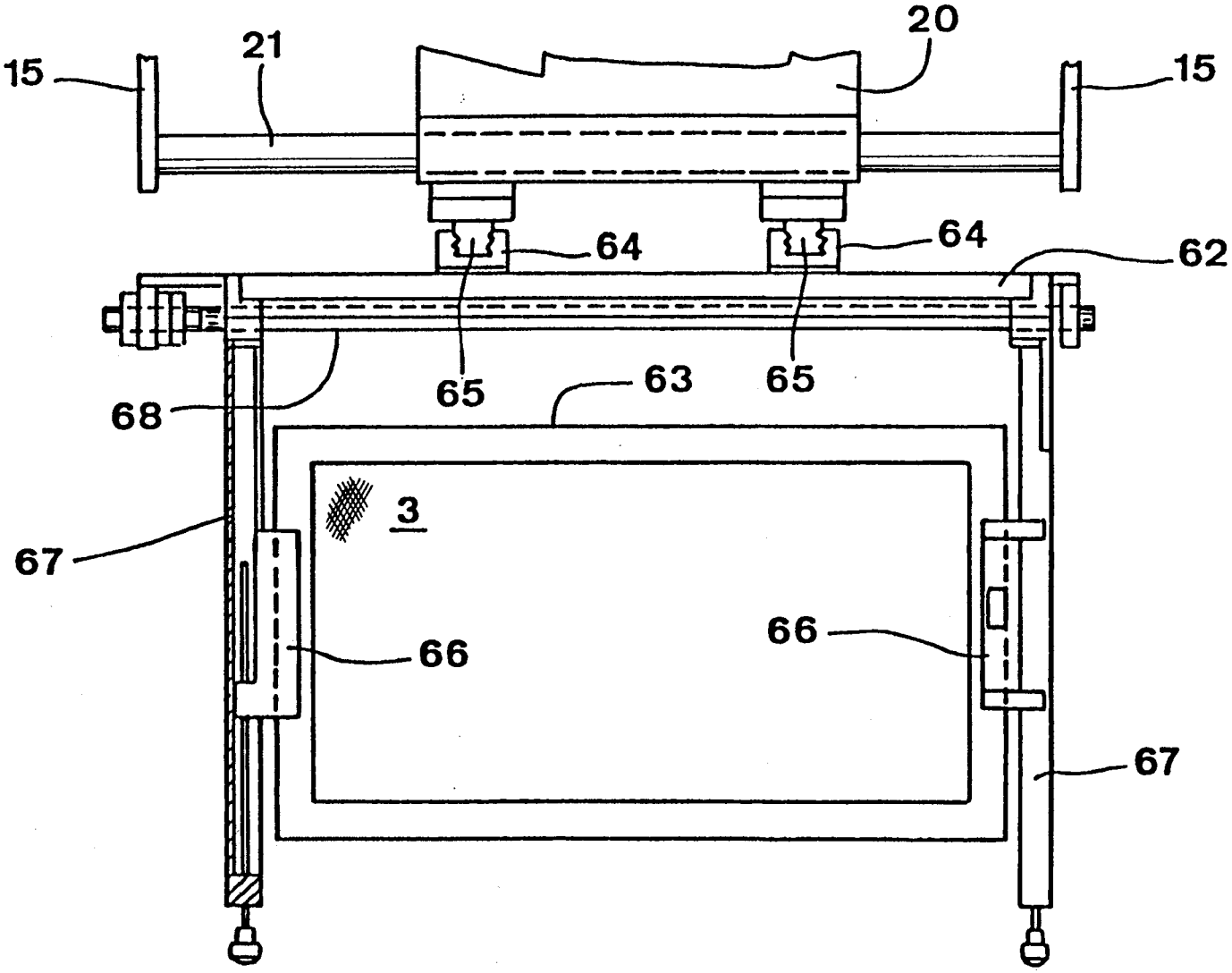
Figure 5:
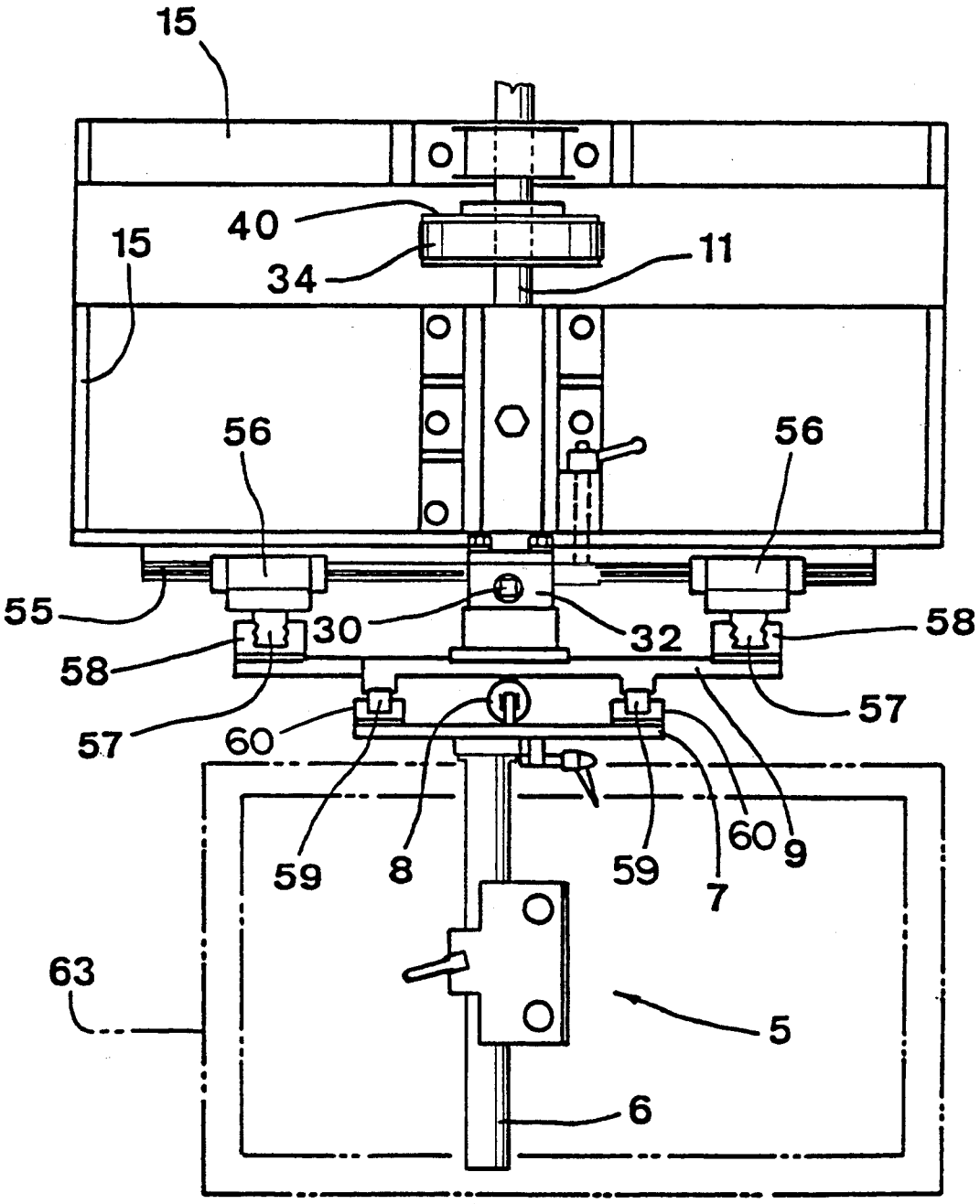
Figure 6:
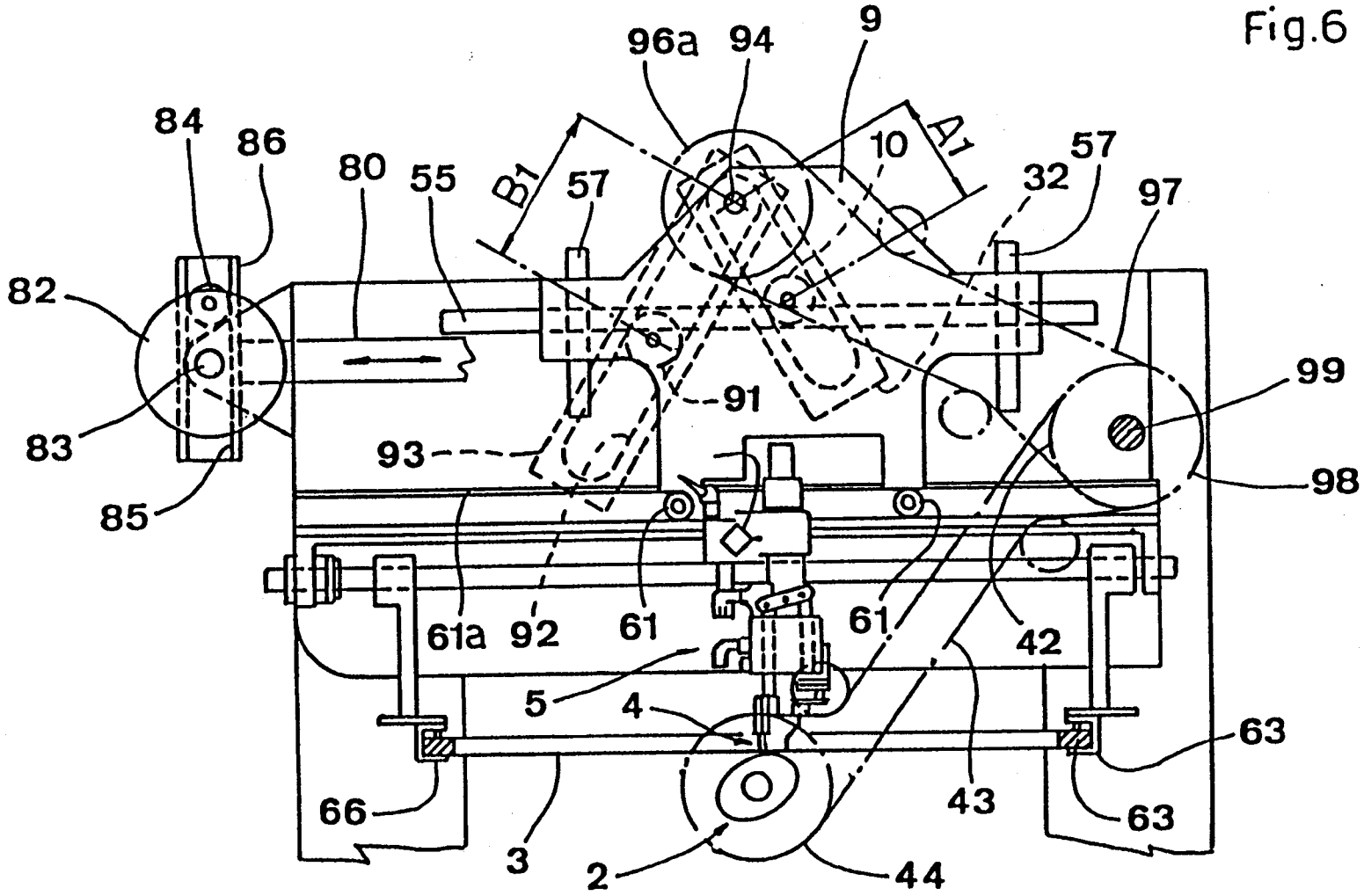
Figure 7:
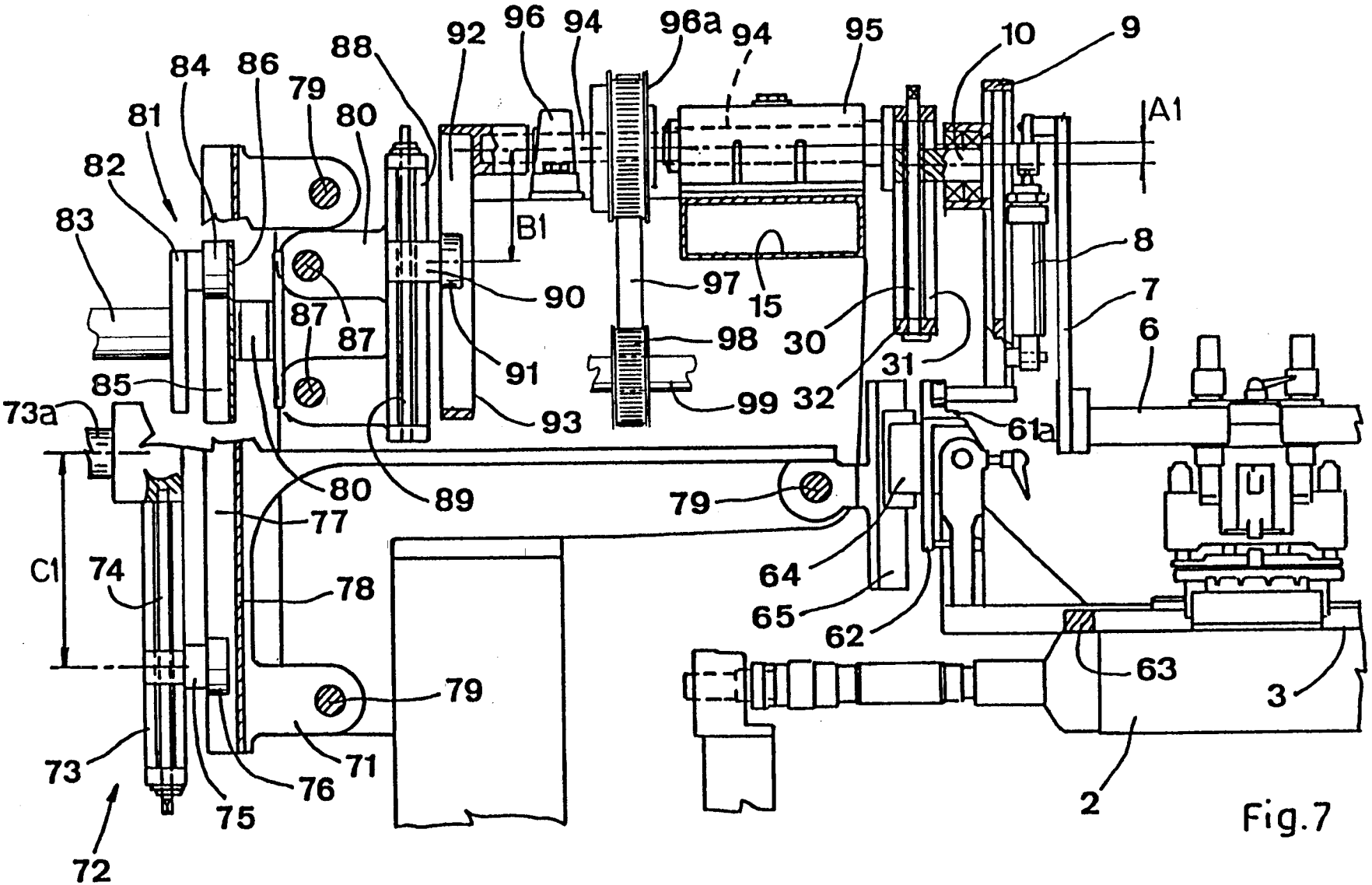
Figure 8:
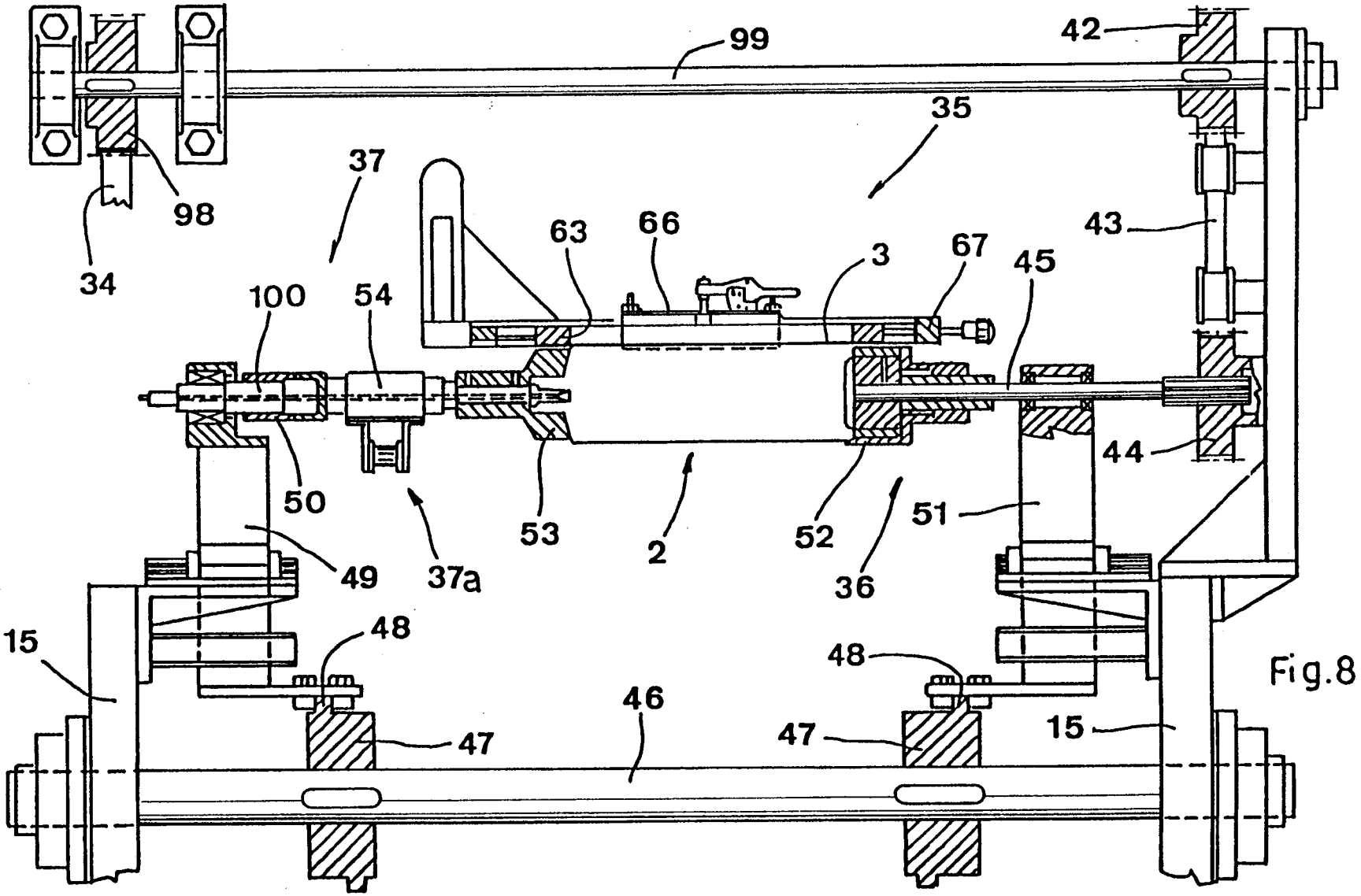
Figure 9:
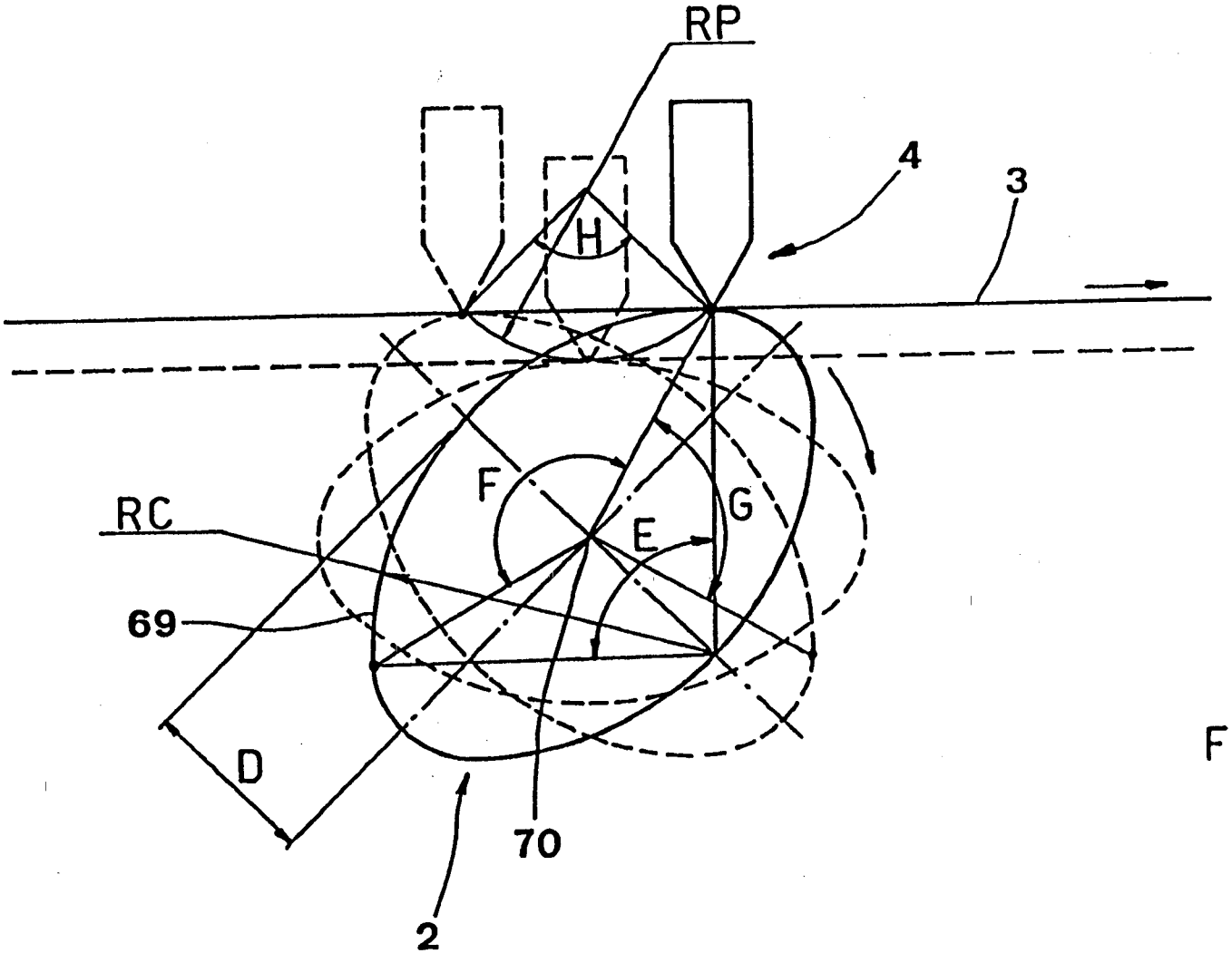

Two ways of putting the invention into effect are illustrated, purely by way of examples, in the nine sketches attached, where: FIG. 1 shows a front view of the machine devised by the invention, in the model with a single drive system for both the screen and the squeegee; FIG. 2 shows the longitudinal section of the back of the screen-printing machine illustrated in FIG. 1; FIG. 3 shows the longitudinal section of the front of the screen-printing machine, illustrating the printing station; FIG. 4 is a plan view of the screen, without squeegee; FIG. 5 is a plan view of the squeegee, showing the outline of the printing screen; FIG. 6 is a front view of the machine illustrated in FIG. 1, but of the model with double drive system for the printing screen and the squeegee; FIG. 7 shows the longitudinal section of the screen-printing machine illustrated in FIG. 6, showing the printing unit; FIG. 8 shows the longitudinal section of the printing station, illustrating the bottle supporting and moving device; FIG. 9 is a schematic view of the longitudinal section of the squeegee and screen units, illustrating their travel limit positions during operation.

The following are illustrated: 1 is the screen-printing machine according to a preferred embodiment of the invention; 2 is the container, over which the ink on the screen is spread, for example a bottle or other hollow object whose transverse section is characterized by a printing surface which is curvilinear, elliptic for example, oval or a sequence of rectilinear and curvilinear elements.

3 is the screen fitted between the container 2 and the squeegee 4 which remains in a right-angled position during any type of operating condition: the squeegee and the screen are kept in contact during operations and oscillate on a vertical plane, synchronized to operate alternately in opposite horizontal directions; 5 is the upper mounting for the squeegee 4 and is fixed to the bottom of the cross beam 6, jutting out from the vertical positioning plate 7 (FIG. 2), adjustable to either a lowered working position corresponding to the degree of contact between the squeegee 4 and the screen 3, or a raised position when not in use, by means of a vertical pneumatically-operated cylinder 8 whose liner is integral to the carriage 9 oscillating on its vertical plane; 10 is an oscillating pin with adjustable height at the back of which the carriage body 9 rotates, forming a downward extension of the horizontal longitudinal drive shaft 11, which drives the oscillating carriage.

A represents the eccentricity between the shaft 11 and the pin 10, whose value in relation to the length B of the rear rocking arm 12 protruding upwards at right angles from the back end of the shaft 11 and whose height is also adjustable, determines the swinging amplitude of the squeegee 4. See FIG. 1. In other words, value A affects the swinging radius whereas B affects the amplitude of the arc.

13 is the front coupling box for the shaft 11; 14 is a rolling element support for the back end of the shaft, both fitted to the frame 15 of the machine 1; 16 is the longitudinal slot on the back rocking arm 12 used to adjust the position of the wheels 17, engaged by the front end of a sliding block 18 which slides inside the top groove on the slide 20 thereby determining the length B of the arm.

21 represents a set of longitudinal guideways, parallel with the slide 20 and whose ends are fixed to the sides of the machine 1; 22 is the back surface of the slide 20, fitted, on the outer surface, with a crank and slotted link **22*a* consisting of a vertical groove 23 on the back surface, along which the rolling element 24 slides, fixed in an adjustable position to the pin 25, connected to the main drive shaft 26 by a crank 27; 28 is the screw adjusting the position of the pin 25 which slides along the longitudinal slot on the crank 27**.

C represents the length of the adjustable arm on the crank 27, which is equal to the longitudinal half-stroke of the screen 3. See FIG. 2. 29 is the screw adjusting the position of the pin 18 in the slot 19; 30 is the corresponding screw used to adjust the position of the pin 10 along the slot 31 made in the body of the front arm 32 protruding from the shaft 11 at right angles, in the opposite direction to the rear arm 12; 33 is an intermediate pulley keyed to the shaft 11 transmitting the oscillating movement, by means of a belt 34 to the container 2 with a unitary transmission ratio.

The container is fitted in the printing station 35 (FIG. 3) by means of axial securing heads, oscillating together, one at the front 36 and one at the back 37, the latter forming part of the chain-driven unit **37*a* feeding the containers 2 to the printing station; 38 is the shaft supporting the rear head 37, splined at the back where the pulley 39 engaged by the belt 34 is attached; 40 is a pair of drive pulleys engaged by the belt 34, mounted on the frame of the machine; 41 is an extension of one of the shafts supporting the pulley 40; a pulley 42 transmitting the rotating motion, by means of a belt 43 to the lower pulley 44 is keyed to the front end of the shaft extension; pulley 44 is coupled to the front splined end of shaft 45, supporting the front head 36**.

46 is a drive shaft which locks the heads 36, 37 axially; two cams 47 are keyed to the ends of this shaft with symmetrically opposite profiles 48 which move the heads together when the container is picked up and moves them away from each other when the container is released; 49 is the driving arm for the rear head 37, linking the relevant cam 47 with the centering element 50 attached to the front end of the shaft 38; 51 is the driving arm for the front head 36, linking the relevant cam 47 with the driving element 52.

The internal profile of this element corresponds to the external profile of the bottom of the container, forming part of the head 36; 53 is the front part of the centering element 54 whose internal profile corresponds with the external profile of the mouth of the container 2; 55 is the track along which the oscillating carriage 9 runs, supporting it on the frame of the machine 15; 56 (FIG. 5) represents the pair of sliding couplings which move along the track, sliding vertically with respect to the back of the carriage 9 along a pair of vertical guideways 57 fixed to the couplings and with their respective sliding blocks 58 attached to the carriage; 59 represents the pair of vertical guideways along which the positioning plate slides, fitted at the rear with sliding blocks 60; 61 represents a pair of rolling elements attached at the back to the bottom of the oscillating carriage 9 which engage the horizontal, longitudinal bilateral track **61*a*; this track has a vertical C-shaped transverse section, open at the front and is mounted on the support 62 of the frame 63 of the screen 3, sliding vertically on a pair of sliding blocks 64, fixed to the back of the moving support 62, engaging with corresponding vertical, prismatic, bilateral tracks 65 hollowed at the front of the slide 20**.

The rolling element group 61 engaged in the track **61*a* allows the screen 3 to move up and down over a distance equal to the stroke length of the squeegee, whilst the counter-phase movement is obtained by inverting the rectilinear movement of the slide 20, driven by the shaft 11 equipped with an invertor with arms 12 and 32 protruding in opposite directions; represents a pair of longitudinal clamps adjusted to secure the frame 63 to the pair of transverse arms 67, protruding from the bar 68 fixed to the sliding support 62**.

RC (FIG. 9) represents the radius of curvature of the transverse section of the container, in correspondence with the printing area; D represents the minimum distance between the surface 69 to be printed and the rotation axis 70 of the container: RP indicates the oscillating radius of the squeegee 4, corresponding to the eccentricity value A between the pin 10 and the shaft 11. This is done according to the formula RP=RC−D, from which, depending on the geometric properties of the container, the eccentricity value A is obtained; E represents the angle at the center which subtends the printing section arc; F represents the angle formed by the arc subtended by angle E measured in respect of the axis of rotation of the bottle; G represents the angle at which the container rotates in one printing stroke, equal to angle F reduced by a quantity proportionate to the angle at the center H of the trajectory followed by the squeegee: the eccentricity values B and C allow the shaft 11 to oscillate at an angle corresponding to either G or H which are analogous; 71 (FIG. 7) is the lower slide which drives the screen, in the machine model with two independent drive assemblies, with alternating rectilinear movement transmitted by the lower crank and slotted link 72, composed of a crank 73, driven by the main motor drive shaft **73*a*, fitted with a longitudinal slot along which a sliding block 75 is positioned by means of a screw 74 used to vary the length C1 of the arm: a rolling element 76 is fitted at the front of the sliding block which moves along a vertical groove 77 in the back 78 of the lower slide 71; 79 is a set of transverse guideways for the slide, 80 is the upper slide which drives the squeegee, with alternating rectilinear movement by means of the upper crank and slotted link 81, composed of a crank 82 protruding radially from the secondary motor drive shaft 83, fitted with a sliding block with rolling element 84 engaged in a groove 85 in the back 86** of the slide.

87 is a pair of transverse guideways at right angles with the slide; 88 is a vertical slot at the front of the slide along which a sliding block 90, adjustable in height by means of a screw 89, is fitted; a rolling element 91, fitted to the front of this sliding block, slides along a longitudinal slot 92 on the transverse arm 93 protruding downward from the bottom end of the oscillating drive shaft 94, analogous to the driving arm 11 in the model with a single drive system (FIGS. 1 to 5): the end of this shaft 94 leads to the rocking arm 32, where B1 represents the length of the rocking arm protruding at right angles from the shaft; 95 is the front coupling supporting the shaft 94 and 96 is a rolling element mounting for the back end of the shaft, both fitted to the frame 15 of the machine 1; **96*a* is an intermediate pulley keyed to the shaft 94 transmitting the oscillating movement, by means of a belt 97, to the container 2, with a unitary transmission ratio; 98 is a pulley which drives the chain 97, mounted on the frame of the machine; 99 is an extension of the shaft supporting the pulley 98; a pulley 42 is keyed to the front end of this shaft; 100 is the shaft supporting the rear head 37 at the front of which is fitted a centering element 50**.

A1 represents the eccentricity between the shaft 94 and the pin 10 whose value, in relation to the length B1 of the rocking arm on the shaft 94 determines the amplitude of the oscillating movement by the squeegee 4.

The machine operates as follows: having moved the container 2 to the printing station 35, moving the feed chain forward one step (distance between one bottle and the next) **37*a* and setting the angular position for the printing stroke, the front 36 and rear 37 heads are locked axially by the rotation of the shaft 46 and the operation of the cams 47, the container is rotated around an axis 70 passing through the centre of the mouth of the container, the surface to be printed rotating, without slipping, on the screen 3 which moves longitudinally with a stroke of equal length to that of the slide 20 and vertically with respect to it by operation of a pair of sliding blocks 64 engaged in a corresponding pair of vertical tracks 65 on the slide, thereby bringing the screen 3 into contact with the container 2, varying the distance between the surface to be printed and the axis of rotation of the container; the drive shaft 11 or 94 transmits the oscillating stroke movement to the squeegee 4, whose lower edge is kept in contact with the surface of the screen 3 by means of the horizontal, longitudinal coupling between the screen supporting frame 63 and the lower appendix of the carriage 9, engaged in the track by means of rolling elements 61**.

In practice, the materials, sizes and operating details may differ from those indicated, but are technically equivalent, without going beyond the legal scope of this invention.

Hence the crank 32 can be replaced with a cam, having a profile corresponding to that of the oscillating stroke of the squeegee 6; the system feeding the containers 3 to the printing station may take any form; finally the screws 28, 29, 30 adjusting the longitudinal stroke of the screen 3 and the amplitude of the oscillating movement of the squeegee 4 can be driven by step-by-step motors linked to a processor which controls the printing phases and the selection of operating parameters on the basis of the geometric properties of the container 3.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

We claim:

1. A silk screen printing machine for decorating an outer surface of a rotatable container having a curved outer surface and rotating around a longitudinal axis, comprising:

a machine frame;

a carriage movably mounted to the machine frame;

a screen having a screen frame supporting a horizontally disposed mesh, said screen being movably supported by said carriage to be disposed above the outer surface of the container, said outer surface having a first radius of curvature, the distance between said outer surface and said longitudinal axis being variable between a maximum value and a minimum value;

a vertically disposed squeegee movably supported by said carriage to be disposed above the screen, the squeegee having a lower edge that contacts and in use scraps an upper surface of the mesh for pressing an ink through the mesh;

driving means for moving the lower edge of the squeegee in an arcuate trajectory having a second radius of curvature;

means for adjusting the second radius of curvature to a value which equals a difference between said first radius of curvature and said minimum value of the distance between said outer surface and said longitudinal axis; and means for adjusting a length of the arcuate trajectory of the squeegee.

2. The silk screen printing machine according to claim 1, wherein:

said means for adjusting the second radius of curvature and a length of the arcuate trajectory of the lower edge of the squeegee comprises a first horizontal drive shaft provided at a first end with a first adjustable extension rotationally connected to said carriage and at a second end with a second adjustable extension; and means for oscillating said first drive shaft, connected with said second adjustable extension.

3. The silk screen printing machine according to claim 2, wherein:

said first drive shaft is equipped at said first end with a first arm protruding at a right angle thereto and provided with a slot accommodating a first adjustment screw for adjusting a position of said first adjustable extension within said slot.

4. The silk screen printing machine according to claim 2, wherein:

said first drive shaft is equipped at said second end with a second arm protruding at a right angle thereto and provided with a slot slidably engaged by said second adjustable extension, and vertically disposed second adjustment screw for adjusting said second adjustable extension.

5. The silk screen printing machine according to claim 4, further comprising:

crank means with an adjustable throw; and a slide, mounted to said machine frame to be reciprocated by the crank means, said second adjustment screw being mounted to said slide.

6. A silk screen printing machine according to claim 2, wherein:

said carriage further comprises a vertically adjustable positioning plate, supporting a horizontal crossbeam to which said squeegee is mounted, and a pneumatically-operated cylinder designed to adjust the position of said vertically adjustable positioning plate.

7. The silk screen printing machine according to claim 6, wherein:

said carriage is provided with first support means for slidably supporting said screen, said screen being equipped with second support means cooperating with said first support means.

8. The silk screen printing machine according to claim 7, wherein:

said first support means comprises a longitudinal bilateral track fitted at the top of said second support means and a pair of rolling elements protruding behind a lower portion of the carriage and rotatably coupled with said longitudinal track;

said second support means further comprising sliding blocks coupled with a pair of vertical, prismatic, bilateral tracks provided at a front side of said slide.

9. The silk screen printing machine according to claim 4, further comprising:

first, second and third cooperating drive shafts, wherein said first drive shaft drives the second drive shaft and the third drive shaft by means of first and second belt and pulley systems respectively;

said second and third driving shafts being coupled to opposite ends of the container for rotating the container during a printing stroke.

10. The silk screen printing machine according to claim 9, wherein:

said first belt and pulley system comprises a first pulley keyed to an intermediate section of the first drive shaft, said first pulley driving by means of a first belt and second, third and fourth pulleys, the fourth pulley being keyed to an end of said second driving shaft, and said second belt and pulley system comprises an intermediate shaft, the third pulley being keyed to one end of said intermediate shaft, a driving pulley being provided at another end of said intermediate shaft, a driven pulley being keyed to one end of said third driving shaft, and a second belt extending between said driving pulley and said driven pulley.

11. The silk screen printing machine according to claim 10, wherein:

said first belt and pulley system further comprises a rotatable front head mounted on said another end of said second drive shaft and said second belt and pulley system comprises a rotatable rear head mounted on another end of the third driving shaft, the container being inserted between said front head and said rear head with said front and rear heads cooperatively providing support and enabling rotation of the container about the axis of said second and third driving shafts.

12. The silk screen printing machine, according to claim 11, wherein:

said front and rear heads are mounted to be axially movable on said second and third driving shafts respectively, the axial movement of the front and rear heads being obtained by means of first and second vertical arms translating in a vertical plane, said first and second arms being respectively driven by first and second cams formed with symmetrically opposite profiles and keyed to a rotatable cam support shaft parallel to said second and third drive shafts.

13. The silk screen printing machine according to claim 11, wherein:

an upper slide is slidably mounted on said machine frame, said second adjustment screw is mounted on said upper slide, and an upper crank means is provided for reciprocating said upper slide.

* * * * *